US006087767A

United States Patent [19]

Sano et al.

[11] Patent Number: 6,087,767

[45] Date of Patent: Jul. 11, 2000

[54] CRT WITH NON-CIRCULAR CONE AND YOKE

[75] Inventors: Yuuichi Sano, Fukaya; Masahiro Yokota, Kumagaya, both of Japan

[73] Assignee: Kabushiki Kaisha Toshiba, Kawasaki, Japan

[21] Appl. No.: 09/100,315

[22] Filed: Jun. 19, 1998

[30] Foreign Application Priority Data

Jun. 20, 1997 [JP] Japan ..... 9-163857

[51] Int. Cl.[7] ..... H01J 29/76

[52] U.S. Cl. ..... 313/440; 313/477 R; 220/2.1 A

[58] Field of Search ..... 313/477 R, 440; 220/2.1 A

[56] References Cited

U.S. PATENT DOCUMENTS

| | | | |
|---|---|---|---|
| 3,731,129 | 5/1973 | Tsuneta et al. | 313/64 |
| 3,806,750 | 4/1974 | Tsuneta et al. | 313/64 |
| 5,763,995 | 6/1998 | Sano et al. | 313/477 R |
| 5,801,481 | 9/1998 | Yokota | 313/440 |
| 5,962,964 | 10/1999 | Sano et al. | 313/440 |

FOREIGN PATENT DOCUMENTS

| | | | |
|---|---|---|---|
| 2 033 159 | 11/1970 | France | H01J 29/00 |
| 20 54 280 | 5/1971 | Germany | H01J 31/20 |
| 48-34349 | 10/1973 | Japan | H01J 31/08 |
| 61-19032 | 5/1986 | Japan | G03G 13/24 |
| 63-241843 | 10/1988 | Japan | H01J 29/76 |
| 2-297842 | 12/1990 | Japan | H01J 29/76 |
| 7-37525 | 2/1995 | Japan | H01J 29/76 |
| 08 007781 | 1/1996 | Japan | H01J 29/76 |

OTHER PUBLICATIONS

Patent abstracts of Japan, vol. 095, No. 005, Jun. 30, 1995, JP 07 037525, Feb. 7, 1995.

*Primary Examiner*—Michael H. Day
*Attorney, Agent, or Firm*—Oblon, Spivak, McClelland, Maier & Neustadt, P.C.

[57] ABSTRACT

A funnel (32) of an envelope of a cathode ray tube has a cone portion (40) and a deflection yoke (37) is mounted on the cone portion (40). The deflection yoke (37) includes a hollow magnetic core (44), and horizontal deflection coils (43H) and vertical deflection coils (43V) which are provided on an inner surface side of the core (44). Each of lateral cross-sections of an outer surface of the cone portion (40) and an inner surface of the core (44), perpendicular to a center axis of the funnel (32), has a substantially rectangular shape, and a gap between the lateral cross-sections of the outer surface of the cone portion (40) and the inner surface of the core (44) includes a non-uniform portion.

12 Claims, 4 Drawing Sheets

CRT WITH NON-CIRCULAR CONE AND YOKE

BACKGROUND OF THE INVENTION

The present invention relates to a cathode ray tube such as a color picture tube or the like, and particularly, to a cathode ray tube which reduces the deflection power and a leakage magnetic field.

For example, a color picture tube as a cathode ray tube comprises a vacuum envelope which has a substantially rectangular panel, a cylindrical neck, and a funnel positioned between the panel and the neck. The larger diameter end of the funnel is connected with the panel and the smaller diameter end of the funnel is connected with the neck.

A phosphor screen consisting of dot-like or stripe-like three-color phosphor layers which radiate in blue, green, and red is formed on the inner surface of the panel. Opposed to the phosphor screen, a shadow mask having a number of electron beam apertures is provided inside the phosphor screen. In addition, an electron gun for emitting three electron beams is arranged in the neck. A deflection yoke is mounted on the envelope so as to extend from the outside of the smaller diameter portion in the neck side of the funnel to the outside of the neck.

Further, in the color picture tube, three electron beams emitted from the electron gun are deflected in the horizontal and vertical directions by horizontal and vertical deflection magnetic fields generated from the deflection yoke, to horizontally and vertically scan the phosphor screen through the shadow mask. A color image is thus displayed.

A self-convergence inline color picture tube is widely put to practical use as a color picture tube as described above. In this picture tube, the electron gun is of an inline type which emits three electron beams which pass through one same horizontal plane, and the horizontal deflection magnetic field generated from the deflection yoke is of a pincushion type while the vertical deflection magnetic field is of a barrel type. Further, the three electron beams arranged in line and emitted from the electron gun are deflected by the horizontal and vertical magnetic fields, to concentrate the three electron beams over the entire phosphor screen without requiring any special correction means.

In this kind of cathode ray tube, reduction of power consumption is a significant problem in view of energy saving. Therefore, it is important for a cathode ray tube to reduce the power consumption of the deflection yoke, and simultaneously, it is desired to reduce leakage of magnetic fields from the deflection yoke.

Specifically, to raise the screen luminance of a cathode ray tube, it is necessary to increase the anode voltage which finally accelerates electron beams. In addition, the deflection frequency must be increased to respond to OA devices such as a HDTV (High Definition Television), a PC (Personal Computer), and the like. However, both the increases of the anode voltage and the deflection frequency lead to an increase in the deflection power.

Meanwhile, in case of an OA device such as a PC which is operated by an operator close to the device, reinforcement is taken with respect to restrictions to a leakage magnetic field which leaks to the outside of the cathode ray tube from the deflection yoke. A countermeasure for such reinforcement is necessary. Conventionally, a method of adding a compensation coil is generally used to reduce the magnetic field that leaks from the deflection yoke. However, if a compensation coil is added, the power consumption is increased.

Generally, in order to reduce the deflection power and the leakage magnetic field in a cathode ray tube, the neck diameter is decreased and the outer diameter of the smaller diameter portion of the funnel where the deflection yoke is installed is also decreased, so that deflection magnetic fields efficiently make effects on electron beams.

However, since electron beams pass close to the inner surface of the smaller diameter portion of the funnel, electron beams extending toward a corner portion of the screen at a maximum deflection angle collide into the inner wall of the smaller diameter portion of the funnel if the neck diameter and the outer diameter of the smaller diameter portion of the funnel are too small. As a result of this, corner portions of the phosphor screen includes a part on which the electron beams cannot reach. If electron beams continue colliding into a part of the inner wall of the smaller diameter portion of the funnel, the temperature of the part increases to melt glass, leading to a risk of implosion. Therefore, in a conventional cathode ray tube, it is difficult to greatly decrease the neck diameter and the outer diameter of the smaller diameter portion of the funnel, to reduce the deflection power.

As a measure for solving the problem as described above, Japanese Patent Application KOKOKU Publication No. 48-34349 suggests the smaller diameter portion of a funnel formed as a pyramid-like cone portion whose cross-section gradually changes from a circular shape to a rectangular shape in a direction toward the panel from the neck side, from the view point that if a rectangular raster is drawn on the phosphor screen, the electron beam passing area in the smaller diameter portion of the funnel on which the deflection yoke is mounted is also substantially rectangular.

If the smaller diameter portion of the funnel is formed to be a pyramid-like cone portion, compared with a normal funnel in which the cross-section of the smaller diameter portion has a substantially circular shape, the diameters in the horizontal and vertical axes are decreased, so that horizontal and vertical deflection coils of the deflection yoke can be arranged closer to courses of the electron beams and the electron beams can be deflected efficiently. The deflection power is therefore reduced.

However, as the cross-section of the cone portion is approximated to a rectangular shape to reduce efficiently the deflection power, the air-pressure withstand strength of the vacuum envelope decreases and the safety is spoiled. Therefore, the shape of the cone portion must be appropriately rounded for practice, and it is therefore difficult to sufficiently reduce the deflection power.

As for the leakage magnetic field, the deflection coil diameter gradually increases from the neck side to the phosphor screen side, and therefore, the magnetic field which leaks toward the phosphor screen extends far. Accordingly, to reduce the leakage of magnetic fields, the diameter of the deflection coil in the side of the phosphor screen must be reduced. Specifically, the cone portion must be shaped to be sufficiently rectangular from the neck side to the phosphor screen side in order to reduce the deflection power and the leakage of magnetic fields.

However, in the vicinity of the end portion of the almost rectangular cone portion, in the phosphor screen side, the cross-sections close to the ends of the horizontal axis (H-axis) and the vertical axis (V-axis) are nearly a flat shape, according to results of analysis of stress calculation, so that these flat shaped portions are deformed in the direction toward the tube axis. As a result, a compressive stress generates in the vicinity of the ends of the horizontal axis (H-axis) and the vertical axis (V-axis), and a tensile stress generates in the vicinity of the ends of the diagonal axes (D-axis) of the cone portion. If the cone portion has a pyramid-like shape, the stress far exceeds 1200 psi which is a standard when designing a general cathode ray tube, so that the cathode ray tube is weak against an external impact and cannot satisfy specifications required for safety.

Also, in case of using a funnel whose cone portion has a pyramid-like shape in a wide angle tube, there can be obtain a cathode ray tube with a practical deflection power. However, since a much greater stress is incurred if the cone portion has a pyramid-like shape as described above, such a cone portion cannot be easily adopted. Finally, to design a tube with a wide deflection angle with use of a funnel whose cone portion has a pyramid-like shape, the cone portion may not be shaped consciously into a pyramid-like shape but should be rounded to some extent in view of the safety, although the reduction efficiency with respect to the deflection power and the leakage of magnetic fields is degraded.

Also, if the cone portion is thus shaped into a pyramid-like shape, costs for components constituting the deflection yoke are increased accordingly. Such a cone portion is not worth while unless it results in an effect of reducing the deflection power and the leakage of magnetic fields, to some extent. It is thus difficult to practice a cathode ray tube having a pyramid-like cone portion.

Meanwhile, for example, Japanese Patent Application KOKAI Publication No. 61-19032 discloses a deflection yoke in which the inner diameter of the core in the vertical direction is reduced in a manner in which a plurality of grooves are formed along the center axis of the inner surface of the core to make the core close to the courses of electron beams as much as possible such that the depths of the grooves decrease as the angles of the grooves with respect to the vertical axis increase, and coil winds of a vertical deflection coil is provided in the grooves.

Also, Japanese Patent Application KOKAI Publication No. 63-241843 discloses a deflection yoke in which the inner diameter of the core in the vertical direction is reduced in a manner in which a plurality of grooves having a substantially equal depth are formed along the center axis such that the inner surface of the core projects in the vicinity of the vertical axis, and coil winds of a vertical deflection coil are provided in the grooves.

Further, Japanese Patent Application KOKAI Publication No. 7-37525 suggests a deflection yoke in which the inner diameter of the core is reduced in a manner in which a vertical deflection coil is shaped to be elliptic along the outer surface of a horizontal deflection coil, and the inner surface of the core is shaped to be elliptic along the outer surface of the vertical deflection coil.

However, every of the deflection yokes described above is installed on a smaller diameter portion of a funnel having a circular lateral cross-section. Therefore, the inner diameter of the core cannot be reduced sufficiently in comparison with a conventional normal deflection yoke, and a great advantage cannot be expected from those deflection yokes. In addition, each of those cores requires a higher manufacturing cost than a conventional normal deflection yoke, resulting in that the costs are increased in spite of its reduced deflection power and it is therefore difficult to put them to practical use.

BRIEF SUMMARY OF THE INVENTION

The present invention has been made in view of the problem described above, and has an object of providing a cathode ray tube which attains necessary strength against air-pressure and sufficiently reduces the deflection power.

In order to achieve the above object, a cathode ray tube according to the present invention comprises: a vacuum envelope having a substantially rectangular face panel, a cylindrical neck, and a funnel extending between the face panel and the neck, the funnel having a cone portion whose outer shape is gradually enlarged from an end of the cone portion on a side of the neck in a direction toward the face panel, and a funnel body whose outer shape is sharply enlarged from an end of the cone portion on a side of the face panel in a direction toward the face panel; an electron gun provided in the neck, for emitting electron beams toward the face panel; and a deflection yoke mounted on the envelope from an outer circumference of the neck to an outer circumference of the cone portion, the deflection yoke including a hollow magnetic core, and a horizontal deflection coil and a vertical deflection coil which are provided on an inner surface side of the core, for deflecting the electron beam emitted from the electron gun.

At least a part of each of lateral cross-sections of an outer surface of the cone portion and an inner surface of the core, perpendicular to a center axis of the funnel, has a non-circular shape, and a gap between the lateral cross-sections of the outer surface of the cone portion and the inner surface of the core includes a non-uniform portion.

Also, in the cathode ray tube according to the present invention, the inner surface of the core is formed such that a lateral cross-section perpendicular to the center axis of the funnel has a shape having concave and convex portions, and there is a portion where the gap is non-uniform between the outer surface of the cone portion and at least one of the concave and convex portions of the inner surface of the core.

Further, in the cathode ray tube according to the present invention, each of the lateral cross-sections of the outer surface of the cone portion and the inner surface of the core, at the non-circular portion, has a long axis and a short axis which are perpendicular to each other and pass through the center axis of the funnel, and each of the lateral cross-sections of the outer surface of the cone portion and the inner surface of the core is approximately defined by a first arc having a center on the long axis, a second arc having a center on the short axis, and a third arc connecting the first and second arcs, and an angle between the long axis and a line passing through a cross point between the long and short axes and a center of the third arc approximately defining the outer surface of the cone portion is different from an angle between the long axis and a line passing through the cross point between the long and short axes and a center of the third arc approximately defining the inner surface of the core.

Also, in the cathode ray tube according to the present invention, the face panel has a long axis and a short axis which are perpendicular to each other and pass through the center axis of the funnel, and the lateral cross-section of the inner surface of the core, perpendicular to the center axis of the funnel, is formed in a non-circular shape which has a maximum diameter in a direction parallel to the long axis of the face panel, at the end portion in the side of the neck, and has a maximum diameter in a direction parallel to a diagonal axis of the face panel, at the end portion in the side of the face panel.

If the smaller diameter portion of the funnel is thus constituted by a cone portion having a non-circular shape and a non-circular deflection yoke to be installed on the cone portion is constructed as has been described above, the deflection power and the leakage of magnetic fields can be sufficiently reduced even when the cone portion is formed into a shape necessary for maintaining strength of a vacuum envelope against atmospheric pressure. Accordingly, it is possible to obtain an improvement of deflection characteristics, equivalent to or more than an increase of costs caused by forming the deflection yoke in a non-circular shape. Even in a tube with a wide deflection angle, it is possible to construct a cathode ray tube apparatus capable of obtaining deflection with a practically useful deflection frequency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 4 show a color cathode ray tube according to an embodiment of the present invention, in which:

FIG. 1 is a cross-sectional view showing the color cathode ray tube;

FIG. 2 is a perspective view showing a back side of the color cathode ray tube;

FIG. 3 is a cross-sectional view taken along a line III—III in FIG. 1;

FIG. 4 is a schematic view explaining arcs defining an outer surface of a cone portion and an inner surface of a core of the color cathode ray tube;

DETAILED DESCRIPTION OF THE INVENTION

In the following, detailed explanation will be made of a color cathode ray tube according to an embodiment of the present invention, with reference to the drawings.

Figure 1:
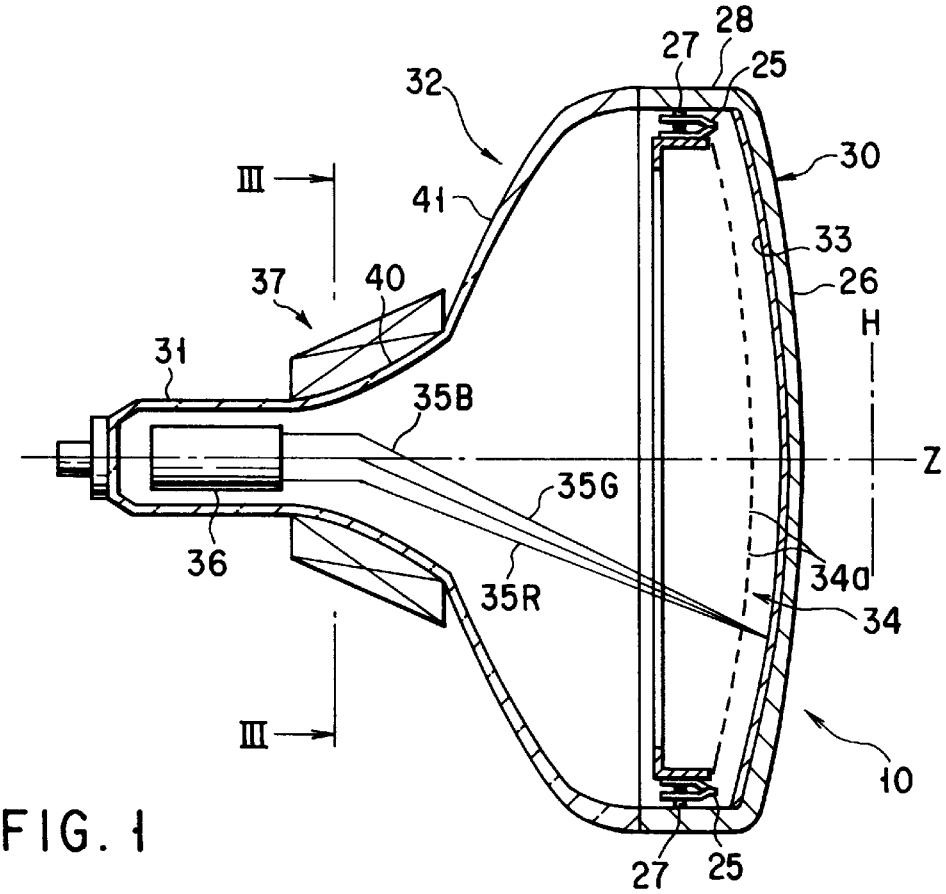

As shown in FIG. 1, a color cathode ray tube comprises a vacuum envelope 10 which includes a face panel 30, a cylindrical neck 31, and a funnel 32 extending between the face panel 30 and the neck 31. The face panel 30 is integrally provided with a rectangular effective portion 26 and a skirt portion 28 standing along the circumferential edge of the effective portion 26. The effective portion 26 has a long axis (or horizontal axis) H passing through a tube axis Z corresponding to the center axis of the funnel 32 and a short axis (or vertical axis) V perpendicular to the long axis, passing through the tube axis. The funnel 32 has a larger diameter end connected to the skirt portion 28 of the face panel 30, and a smaller diameter end connected to the neck 31 by a neck seal portion.

A phosphor screen 33 having of three-color phosphor layers which radiate in blue, green, and red is formed on the inner surface of the effective portion 26. Inside the face panel 30, a shadow mask 34 having a number of electron beam apertures 34*a* is arranged to oppose the phosphor screen 33. The shadow mask 34 is installed on a plurality of stud pins standing on the skirt portion 28 of the face panel 30 by holders 25, respectively.

An electron gun 36 which emits three electron beams 35B, 35G, and 35R is arranged in the neck 31. Further, a deflection yoke 37 is mounted on the funnel 32 and extends from the outside of the neck 31 to the outside of the smaller diameter portion of the funnel 32.

In the cathode ray tube described above, three electron beams 35B, 35G, and 35R emitted from the electron gun 36 are deflected by horizontal and vertical deflection magnetic fields generated from the deflection yoke 37, so as to scan horizontally and vertically the phosphor screen 33 through the shadow mask 34. A color image is thus displayed.

Figure 2:
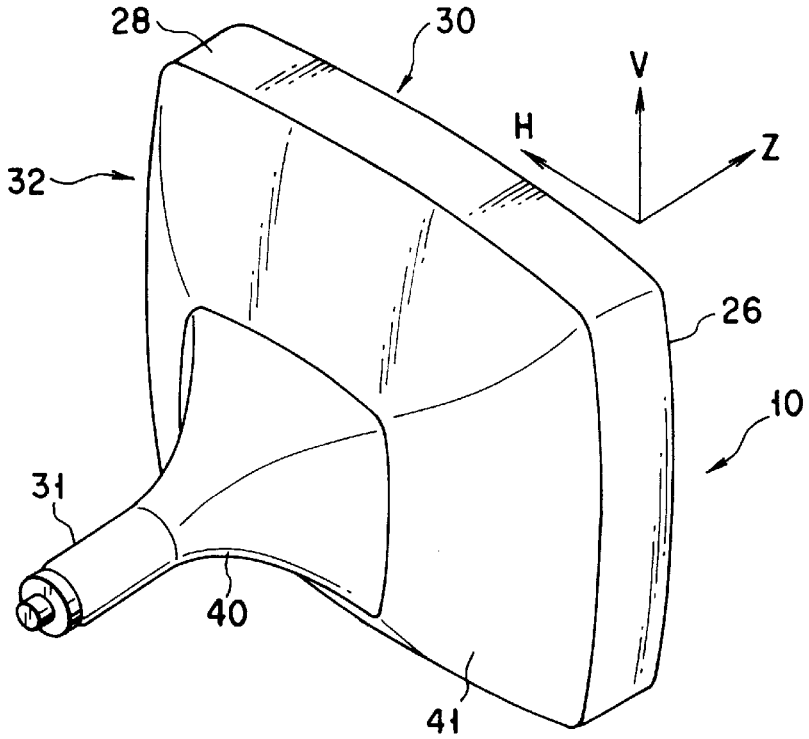
Figure 3:
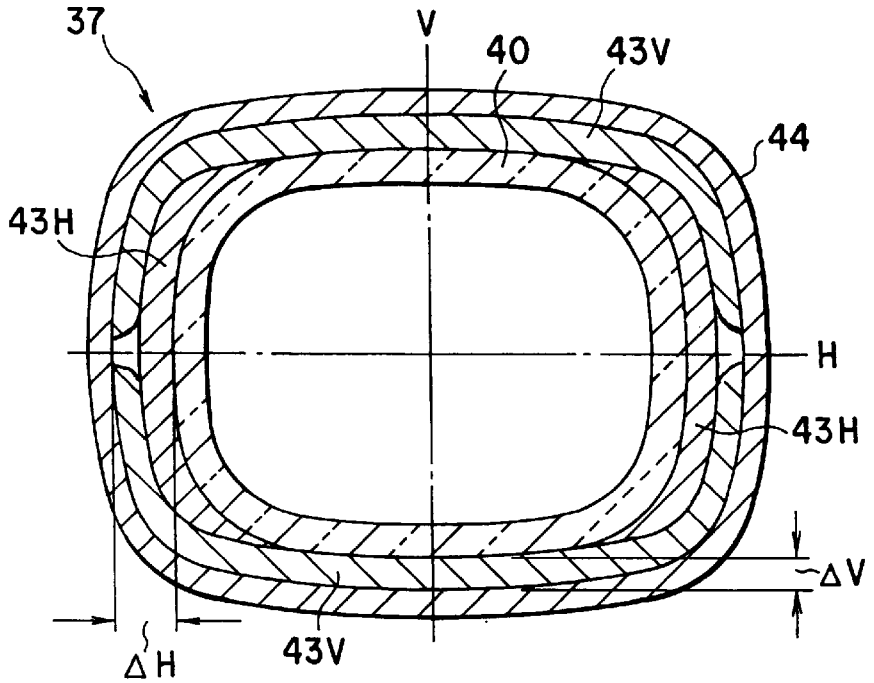

More specifically, as shown in FIGS. 1 and 2, the funnel 32 is comprised of a pyramid-like cone portion 40 whose outer diameter gradually increases toward the face panel 30 from an end of the neck 31, and a funnel body 41 whose outer diameter sharply increases from the end of the cone portion 40 in the side of the face panel 30. As shown in FIG. 3, the pyramid-like cone portion 40 is formed in a shape whose lateral cross-section perpendicular to the tube axis Z is substantially rectangular and rounded appropriately, and has a horizontal axis as a long axis H and a vertical axis as its short axis V, so that the vacuum envelope 10 maintains sufficient strength against atmospheric pressure.

As shown in FIG. 3, the deflection yoke 37 is equipped so as to cover the funnel 32 from the outside of the neck 31 to the outside of the cone portion 40, and the deflection yoke 37 has a horizontal deflection coil 43H for deflecting three electron beams 35B, 35G, and 35R emitted from the electron gun 36 in the horizontal direction, a vertical deflection coil 43V for deflecting the three electron beams in the vertical direction, and a hollow magnetic core 44.

The horizontal deflection coil 43H is arranged to incline to the horizontal axis and is provided along the outer surface of the cone portion 40 at the vicinity of the long axis H. On the other hand, the vertical deflection coil 43V is arranged along almost all the circumference of the cone portion 40 so as to cover the horizontal deflection coil 43V. Further, the core 44 is arranged outside the horizontal and vertical deflection coils 43H and 43V, so as to surround the coils.

Specifically, in the deflection yoke 37, the core 44 is formed in a pyramid-like cylindrical shape corresponding to the outer shape of the cone portion 40, and the horizontal and vertical deflection coils 43H and 43V are equipped inside the core. Further, the gap between the core 44 and the cone portion 40 is not uniform as indicated by a gap $\Delta H$ in the direction of the long axis H and a gap $\Delta V$ in the direction of the short axis V are not uniform, but is narrower in the vertical direction than in the horizontal direction, i.e., the gap $\Delta V$ in the direction of the short axis V is smaller than the gap $\Delta H$ in the direction of the long axis H ($\Delta H > \Delta V$).

Figure 4:
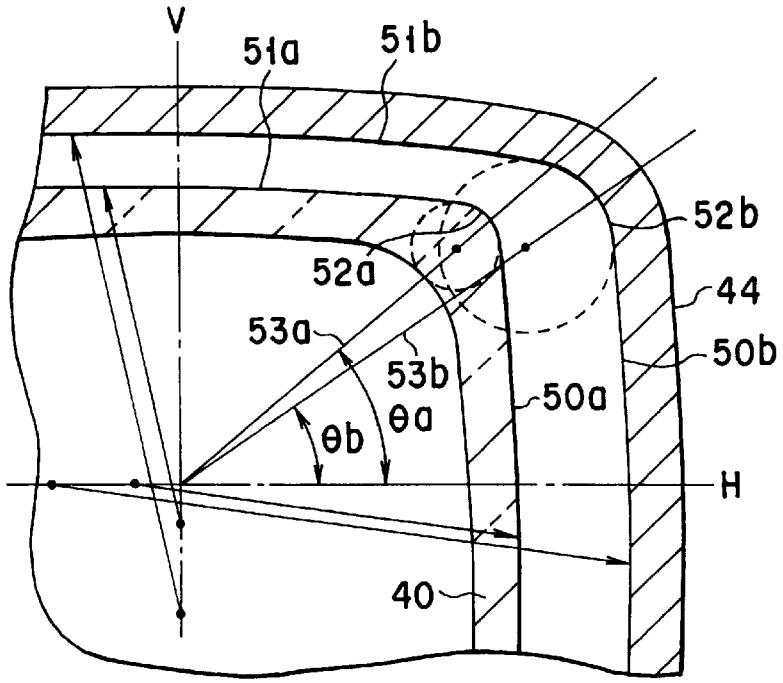

In this case, as shown in FIG. 4, of the entire outer surface of the cone portion 40 and the entire inner surface of the core 44, those surfaces that extend in the vertical direction are respectively approximately defined by first arcs 50*a* and 50*b* having centers on the long axis H, and those surfaces that extend in the horizontal direction are respectively approximately defined by second arcs 51*a* and 51*b* having centers on the short axis V. Further, the first arcs 50*a* and 50*b* are smoothly continued with the second arcs 51*a* and 51*b* by third arcs 52*a* and 52*b*, respectively. An angle θa and an angle θb are set so as to satisfy a relation of θa>θb where the angle θa is an angle between the long axis H and a line 53*a* passing through the center of the third arc 52*a* and the cross point between the long and short axes, while the angle θb is an angle between the long axis H and a line 53*b* passing through the center of the third arc 52*b* and a cross point between the long and short axes. In this manner, the gap between the inner surface of the core 44 and the outer surface of the cone portion 40 is approximately defined to be narrower in the vertical direction than in the long axis direction, and is thus not uniform.

By thus adopting a structure in which the smaller diameter portion of the funnel 32 is formed as a cone portion 40 having a pyramid-like shape and the gap between the cone portion 40 and the core 44 of the deflection yoke 37 installed on the cone portion 40 is not uniform, the inner diameter of the core 44 can be greatly reduced so that the deflection power and the leakage of magnetic fields can be greatly reduced. Particularly, if the core 44 of the deflection yoke 37 is formed in a substantially rectangular shape which may be approximately defined by three arcs 50*a*, 50*b*, 51*a*, 51*b*, and 52*a*, 52*b* as in the corn portion 40, ΔH and ΔV can be non-uniform and the gap near the diagonal axis can be smoothly continued when the angle θa and the angle θb are set so as to satisfy the relation of θa>θb.

Specifically, the distribution of coil winds of a deflection yoke is generally determined so as to optimize the convergence characteristic of three electron beams on the screen. As a result of specifically analyzing the characteristics of the deflection yoke, where the smaller diameter portion of the funnel 32 is formed as a pyramid-like cone portion 40 and the cross-section of the cone portion 40 is shaped into a rectangular having a horizontal axis as a long axis and a vertical axis as a short axis, the size in the short axis direction is particularly shortened in relation to the size of in the diagonal direction, in this cross section. Therefore, the horizontal deflection magnetic filed tends to be a barrel shape, and the vertical deflection magnetic filed tends to be a pin-cushion shape. Thus, for obtaining a suitable magnetic filed, the horizontal deflection coil is provided with a distribution more deviated to the vicinity of the horizontal axis, and winds of the vertical deflection coil deviated to the vicinity of the vertical axis tends to be distributed over the entire circumference. Further, in a conventional cathode ray tube with a rectangular yoke portion where the gap between the core and the cone portion is set to be uniform over the entire circumference (ΔH=ΔV), a large clearance where no coil wind is provided remains between the vertical deflection coil and the cone portion.

In contrast, according to the present embodiment, the gap between the core 44 and the cone portion 40 is approximately defined to be not uniform in the outer circumferential direction of the cone portion 40. In this manner, the clearance between the vertical deflection coil 43V and the outer surface of the cone portion 40 can be eliminated and the size of the core 44 in the direction of the short axis V can be reduced by particularly setting a relationship of ΔH>ΔV. As a result of this, the deflection power and the leakage of magnetic fields from the deflection yoke 37 can be reduced.

In addition, since a core having a pyramid-like shape has been conventionally used as the core 44 of the deflection yoke 37, there will be a small risk even if the gap between the core 44 and the cone portion 40 is approximately defined to be not uniform. An advantage of an improvement in characteristic equivalent to or more than an increase of costs can be obtained.

Figure 5:
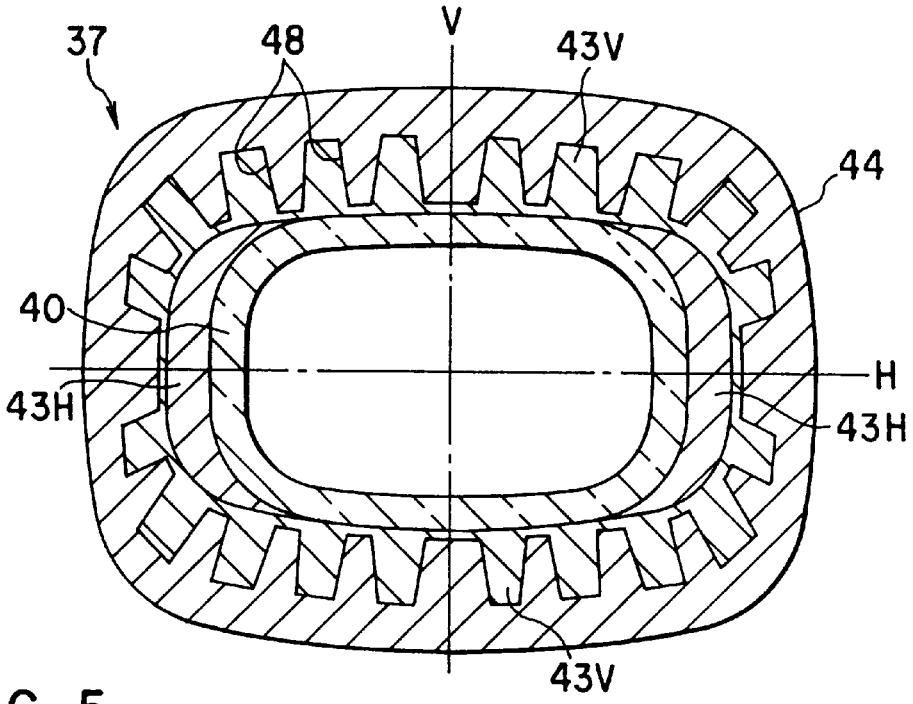
FIG. 5 is a cross-sectional view corresponding to FIG. 3 and showing a color cathode ray tube according to another embodiment of the present invention.

Next explanation will be made of a second embodiment. According to the second embodiment, the core 44 of the pyramid-like deflection yoke 37 installed on the pyramid-like cone portion 40 has a plurality of grooves 48 formed in the inner surface of the core, as shown in FIG. 5. These grooves 48 extend along the center axis of the core 44, i.e., the tube axis Z.

Inside the core 44, horizontal deflection coils 43H are provided along the outer surface of the pyramid-like cone portion 40 and located near the both ends of the long axis H, and also, vertical deflection coils 43V are provided, with its winds embedded in the grooves 48 in the inner surface of the core 44. The gap between the outer surface of the cone portion 40 and at least ones of the convex portions and the concave portions (or bottoms of the grooves) in the inner surface of the core 44 is approximately defined to be not uniform but is narrower in the direction of the short axis V than in the direction of the long axis H.

Even in the second embodiment constructed as described above, the same advantages as in the deflection yoke of the first embodiment described before can be obtained.

Then a third embodiment of the present invention will be described.

Figure 6:
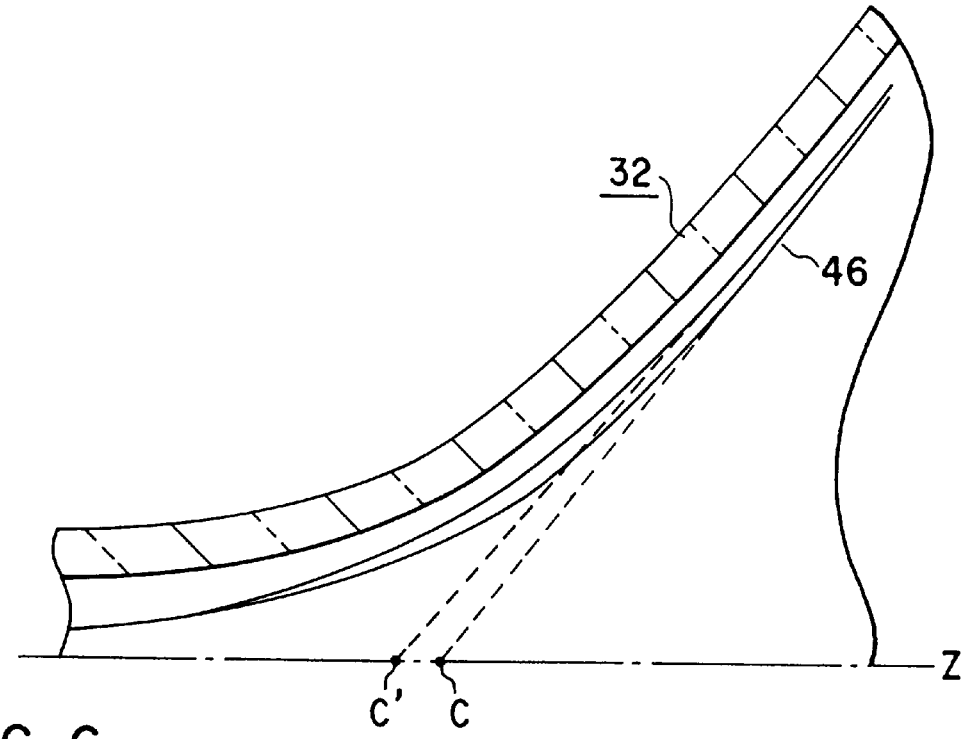
FIG. 6 is a cross-sectional view schematically showing the courses of electron beams of the color cathode ray tube.

If the cone portion 40 is formed to have a pyramid-like shape as described above and a pyramid-like deflection yoke 37 is installed on the cone portion 40, as shown in FIG. 6, the course of electron beams 46 deflected toward a corner portion of the phosphor screen change such that the substantial deflection center C as a cross point between an extended line (indicated by a broken line) and a tube axis Z is moved forwards in the direction to the phosphor screen from a deflection center C' of a normal cathode ray tube in which a conical deflection yoke is installed on a conical cylindrical small diameter portion of a funnel. This means that the deflection yoke 37 is approximated to the courses of electron beams in comparison with a normal cathode ray tube as described above, so that the electron beams can be sharply deflected, in case where a pyramid-like deflection yoke 37 is installed on a pyramid-like cone portion 40. Such a deflection center C can be shifted backwards in a manner in which the lateral cross-sectional shape of the core 44 in the neck side can be arranged in a non-circular shape along the deflection coil and the diameter of the core in the neck side can be reduced as much as possible, thereby to strengthen the deflection force at a rear portion of the deflection yoke.

Specifically, a desired deflection yoke 37 can be attained by forming the lateral cross-sectional shape of the inner surface of the core 44 such that the size thereof in the direction of the long axis H is maximized in the neck 31 side while the size in the direction of the diagonal axis of the face panel is maximized in the face panel 30 side.

Figure 7:
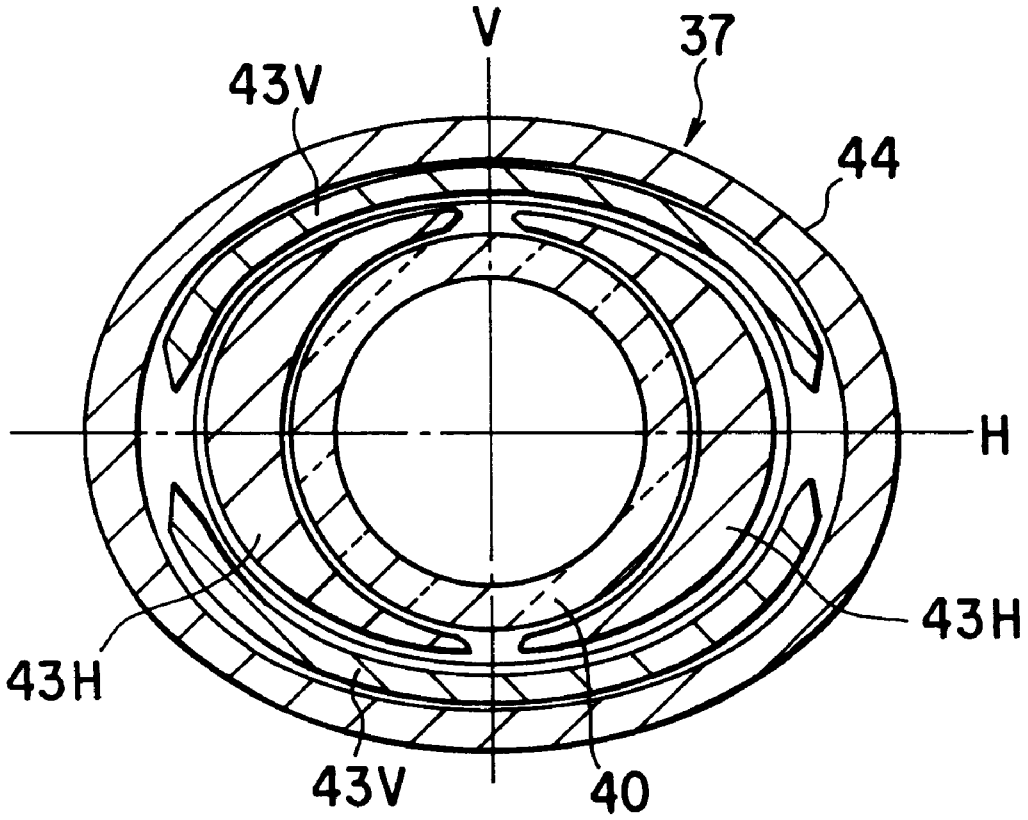
FIG. 7 is an end surface view showing a neck side end portion of a deflection yoke of a color cathode ray tube according to further another embodiment of the present invention.

FIG. 7 is a view showing an end portion of a pyramid-like deflection yoke 37 installed on a pyramid-like cone portion 40, in the neck side. The inner surface of the core 44 has a maximum diameter in the direction along the long axis H and is formed in a shape along a vertical deflection coil 43V. In contrast, another end portion of the core 44 in the face panel side has a substantially rectangular shape having a maximum diameter in the directions along the diagonal axes.

Although the deflection yoke 37 shown in FIG. 7 is arranged such that the core 44 is constructed in a structure having a smooth inner surface, a plurality of grooves may be formed along the center axis of the funnel in the inner surface of the core and winds of the vertical deflection coils may be provided in the grooves. In this structure, the deflection yoke has the same advantages as the deflection yokes according to the embodiments described above.

Note that the present invention is not limited to a color cathode ray tube but is applicable to another kind of cathode ray tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as approximately defined by the appended claims and their equivalents.

What is claimed is:

1. A cathode ray tube comprising:

a vacuum envelope having a substantially rectangular face panel, a cylindrical neck, and a funnel extending between the face panel and the neck, the funnel having a cone portion whose outer circumference is gradually enlarged from an end of the cone portion on a side of the neck in a direction toward the face panel, and a funnel body whose outer circumference is sharply enlarged from an end of the cone portion on a side of the face panel in a direction toward the face panel;

an electron gun arranged in the neck, for emitting electron beams toward the face panel; and a deflection yoke installed on the envelope and extending from an outer circumference of the neck to an outer circumference of the cone portion, the deflection yoke including a hollow magnetic core, and a horizontal deflection coil and a vertical deflection coil provided on an inner surface side of the core, for deflecting the electron beams emitted from the electron gun;

at least a part of each of lateral cross-sections of an outer surface of the cone portion and an inner surface of the core, perpendicular to a center axis of the funnel, having a non-circular shape, and a gap between the lateral cross-sections of the outer surface of the cone portion and the inner surface of the core includes a non-uniform portion.

2. A cathode ray tube according to claim 1, wherein the face panel has a long axis and a short axis which are perpendicular to each other and pass through the center axis of the funnel, and the lateral cross-section of the inner surface of the core, perpendicular to the center axis of the funnel, is formed in a non-circular shape which has a maximum diameter in a direction parallel to a diagonal axis of the face panel, at an end portion on the side of the face panel.

3. A cathode ray tube according to claim 2, wherein each of the lateral cross-sections of the outer surface of the cone portion and the lateral cross-section of the inner surface of the core, at the non-circular portion, has a long axis and a short axis which are perpendicular to each other and pass through the center axis of the funnel, and each of the lateral cross-sections of the outer surface of the cone portion and the inner surface of the core is approximately defined by a first arc having a center on the long axis, a second arc having a center on the short axis, and a third arc connecting the first and second arcs, and an angle between the long axis and a line passing through a cross point between the long and short axes and the center of the third arc approximately defining the outer surface of the cone portion is different from an angle between the long axis and a line passing through the cross point between the long and short axes and the center of the third arc approximately defining the inner surface of the core.

4. A cathode ray tube according to claim 3, wherein the inner surface of the core is formed such that a lateral cross-section perpendicular to the center axis of the funnel has a shape having concave and convex portions, and the gap between the outer surface of the cone portion and at least one of the concave portions and the convex portions of the inner surface of the core includes a non-uniform portion.

5. A cathode ray tube according to claim 4, wherein the core has a plurality of grooves formed in the inner surface of the core and extending along the center axis of the funnel, and one of the vertical and horizontal deflection coils is provided in the grooves.

6. A cathode ray tube according to claim 5, wherein a lateral cross-section of the cone portion, perpendicular to the center axis of the funnel, has a substantially rectangular shape having a long axis and a short axis which are perpendicular to each other and pass through the center axis, a lateral cross-section of the deflection yoke, arranged outside the cone portion, perpendicular to the center axis of the funnel, has a substantially rectangular shape having the long axis and the short axis, and a gap between the outer surface of the cone portion and the inner surface of the core in a direction of the short axis is smaller than a gap between the outer surface of the cone portion and the inner surface of the core in a direction of the long axis.

7. A cathode ray tube according to claim 6, wherein the angle between the long axis and a line passing through the cross point between the long and short axes and the center of the third arc approximately defining the outer surface of the cone portion is larger than from the angle between the long axis and a line passing through the cross point between the long and short axes and the center of the third arc approximately defining the inner surface of the core.

8. A cathode ray tube according to claim 2, wherein the lateral cross-section of the inner surface of the core, perpendicular to the center axis of the funnel, is formed in a non-circular shape which has a maximum diameter in a direction parallel to the long axis of the face panel, at an end portion on the side of the neck.

9. A cathode ray tube according to claim 3, wherein a lateral cross-section of the cone portion, perpendicular to the center axis of the funnel, has a substantially rectangular shape having a long axis and a short axis which are perpendicular to each other and pass through the center axis, a lateral cross-section of the deflection yoke, arranged outside the cone portion, perpendicular to the center axis of the funnel, has a substantially rectangular shape having the long axis and the short axis, and a gap between the outer surface of the cone portion and the inner surface of the core in a direction of the short axis is smaller than a gap between the outer surface of the cone portion and the inner surface of the core in a direction of the long axis.

10. A cathode ray tube according to claim 9, wherein the angle between the long axis and a line passing through the cross point between the long and short axes and the center of the third arc approximately defining the outer surface of the cone portion is larger than from the angle between the long axis and a line passing through the cross point between the long and short axes and the center of the third arc approximately defining the inner surface of the core.

11. A cathode ray tube according to claim 4, wherein a lateral cross-section of the cone portion, perpendicular to the center axis of the funnel, has a substantially rectangular shape having a long axis and a short axis which are perpendicular to each other and pass through the center axis, a lateral cross-section of the deflection yoke, arranged outside the cone portions perpendicular to the center axis of the funnel, has a substantially rectangular shape having the long axis and the short axis, and a gap between the outer surface of the cone portion and the inner surface of the core in a direction of the short axis is smaller than a gap between the outer surface of the cone portion and the inner surface of the core in a direction of the long axis.

12. A cathode ray tube according to claim 11, wherein the angle between the long axis and a line passing through the cross point between the long and short axes and the center of the third arc approximately defining the outer surface of the cone portion is larger than from the angle between the long axis and a line passing through the cross point between the long and short axes and the center of the third arc approximately defining the inner surface of the core.

* * * * *